US006454552B1

(12) United States Patent
Hansen et al.

(10) Patent No.: US 6,454,552 B1
(45) Date of Patent: Sep. 24, 2002

(54) FLUID MOVER

(76) Inventors: Craig N. Hansen, 14920 Minnetonka Industrial Rd., Minnetonka, MN (US) 55345; Paul C. Cross, 14920 Minnetonka Industrial Rd., Minnetonka, MN (US) 55345

( * ) Notice: Subject to any disclaimer, the term of this patent is extended or adjusted under 35 U.S.C. 154(b) by 0 days.

(21) Appl. No.: 09/867,981

(22) Filed: May 30, 2001

Related U.S. Application Data

(62) Division of application No. 09/504,199, filed on Feb. 15, 2000, now Pat. No. 6,241,498, which is a division of application No. 09/118,625, filed on Jul. 17, 1998, now Pat. No. 6,138,646.

(60) Provisional application No. 60/053,148, filed on Jul. 18, 1997.

(51) Int. Cl.[7] ..... F04C 18/08

(52) U.S. Cl. ..... 418/206.5; 418/206.7

(58) Field of Search ..... 418/206.1, 206.4, 418/206.5, 206.7

(56) References Cited

U.S. PATENT DOCUMENTS

| | | | | | |
|---|---|---|---|---|---|
| 30,157 | A | * | 9/1860 | Roots | |
| 5,137,055 | A | * | 3/1873 | Chapman | |
| 337,551 | A | * | 3/1886 | Berrenberg | |
| 349,270 | A | * | 9/1886 | Cheever | |
| 380,764 | A | * | 4/1888 | Pearson | |
| 971,671 | A | * | 10/1910 | Geer | 418/206.2 |
| 1,059,163 | A | * | 4/1913 | Jendrusik | |
| 1,120,828 | A | * | 12/1914 | Lowry | 123/559.1 |
| 1,325,266 | A | * | 12/1919 | Smith | 123/559.1 |
| 1,846,656 | A | * | 2/1932 | Rayfield | 417/44.2 |
| 1,923,268 | A | * | 8/1933 | Jensen | |
| 2,188,752 | A | * | 1/1940 | Houghton | |
| 2,201,693 | A | * | 5/1940 | Heess et al. | 123/559.1 |
| 3,020,901 | A | * | 2/1962 | Cook | 123/559.1 |
| 3,275,225 | A | * | 9/1966 | Schultz | |
| 3,602,617 | A | * | 8/1971 | Takahashi | |
| 3,799,713 | A | * | 3/1974 | Cloots et al. | |
| 3,847,128 | A | * | 11/1974 | Palotsee | |
| 4,057,375 | A | * | 11/1977 | Nachtrieb | |
| 4,116,187 | A | * | 9/1978 | Moore | |
| 4,145,168 | A | * | 3/1979 | Smith, Jr. et al. | |
| 4,215,977 | A | * | 8/1980 | Weatherston | |
| 5,439,358 | A | * | 8/1995 | Weinbrecht | |
| 5,638,600 | A | * | 6/1997 | Rao et al. | |

FOREIGN PATENT DOCUMENTS

| | | |
|---|---|---|
| AT | 193063 | * 11/1957 |
| FR | 619576 | * 1/1927 |
| FR | 644016 | * 5/1928 |

* cited by examiner

*Primary Examiner*—Michael Koczo

(57) ABSTRACT

A pump for moving a fluid has a housing with an internal chamber accommodating a pair of rotors mounted on parallel shafts connected with gears operable to rotate the shafts in opposite directions. Each rotor has opposite end walls and protrusions and pockets that register in non-contacting relation during rotation of the rotors. Thrust bearings cooperating with the gears, shaft, and housing maintain the end walls of the rotors in spaced relation relative to the adjacent walls of the housing.

12 Claims, 7 Drawing Sheets

FLUID MOVER

CROSS REFERENCE TO RELATED APPLICATION

This application is a division of U.S. patent application Ser. No. 09/504,199 filed Feb. 15, 2000, now U.S. Pat. No. 6,241,498. Application Ser. No. 09/504,199 is a division of U.S. Application Ser. No. 09/118,625 filed Jul. 17, 1998, now U.S. Pat. No. 6,138,646. Application Ser. No. 09/118,625 claims the priority date of U.S. Provisional Application Ser. No. 60/053,148 filed Jul. 18, 1997.

FIELD OF THE INVENTION

The invention relates to fluid pumps, such as blowers and superchargers for internal combustion engines, and other processes requiring large volumes of fluid at relatively low pressure.

BACKGROUND OF THE INVENTION

In an internal combustion engine a boost in horsepower can be accomplished by forcing a more dense air/fuel charge into the cylinders with a supercharger. A supercharger can provide a dependable and affordable method of increasing horsepower and torque. A supercharger forces a more dense air/fuel mixture into an internal combustion engine's cylinders than the engine can draw in under normal conditions. This higher-energy mixture produces more power. Supercharging increases the engine's volumetric flow without increasing its displacement. Therefore, a supercharged small engine can produce the horsepower and torque of a relatively larger engine.

There are two basic blower systems used to force an air/fuel mixture into an internal combustion engine. These blowers are either a dynamic or a positive displacement equipment. Turbocharging, which is a dynamic process, places a turbine wheel in the exhaust flow of the engine. The turbine blades are directly connected to a centrifugal blower. One major disadvantage of a turbocharger is "turbo-lag." This is the delay that occurs after calling for power with the throttle before the rotational speed of the system spools up to deliver that power. An improperly sized or designed turbo system can rapidly over-boost and damage a spark-ignited internal combustion engine. The sizing of the turbocharger to the engine and the matching of the turbine size and design to impeller size and design are very critical. Additionally, the exhaust turbine tends to cool the exhaust gases thereby delaying the catalyst light-off of modern automotive emissions systems.

Centrifugal impeller-type supercharging is a system having an impeller rotated with a drive belt from the crankshaft. A speed-increaser, either geared or gearless, is required to multiply the speed of the impeller relative to that of the input shaft. The delivery of a centrifugal impeller-type device varies dramatically with its rotational speed, and is prone to under-boost at low speed and over-boost at high speed. An example of a centrifugal impeller supercharger is disclosed by M. Shirai in U.S. Pat. No. 5,158,427.

The most common positive displacement system is the "Roots blower". In this system, a belt-driven shaft drives two close-clearance rotors which are geared together. Each full rotation sweeps out a specific fixed volume, unlike the fan-like characteristics of a turbine device.

SUMMARY OF THE INVENTION

The invention is a fluid pump used as a supercharger to provide an air/fuel mixture to an internal combustion engine in an efficient and reliable manner for sharply increasing the torque and corresponding horsepower of the engine across its entire operating speed range. The supercharger has simple geometric shaped structures which are easy to fabricate at a relatively low cost. The supercharger employs a pair of cooperating rotors that do not have complex curved surfaces which require relatively costly NC profile milling or dedicated machine tool operations. Conventional materials such as aluminum, cast iron or plastics and established fabrication procedures are used to manufacture the supercharger.

The supercharger rotors have clearances relative to their cooperating or mating surfaces and housing surfaces that accommodate deflection. The cylindrical shapes of the rotors and inside surfaces of the housing allow for predictable and repeatable clearances between non-contacting mating parts. This reduces leakage which improves efficiency while maintaining low cost manufacturing procedures. The cylindrical shapes of the supercharger rotors and associated surfaces are inherently rigid and not prone to flexing and twisting when subjected to pressures and inertial loads.

The supercharger has a housing with two generally cylindrical chambers open to each other and fluid inlet and outlet ports. A rotor assembly located in the chambers operates to draw fluid, such as an air/fuel mixture, into the chambers and discharge the fluid out the outlet port and into the intake of an internal combustion engine. The rotor assembly has a pair of rotors mounted on shafts rotatably supported on the housing. Each rotor has semi-cylindrical pockets and semi-cylindrical protrusions that cooperate with the pockets of the adjacent rotor to move fluid through the supercharger when the rotors are rotated. The protrusions on each rotor do not contact the inside cylindrical surfaces of the housing. Also, the protrusions on each rotor do not contact the cooperating rotor as they move into and out of the mating pockets. This allows for both high speed and oil free operation. The protrusions are integral portions of the rotor. The protrusions are located in the semi-cylindrical pockets of the adjacent rotor generally half of the time during rotation of the rotors. Therefore, the pressure fluctuations and associated noise and heat are reduced. There is minimal trapped volume of fluid in the pockets. This reduces one of the common sources of noise, heat, and vibrations among prior devices. Additionally, the fluid inlet has two passages. This improves volumetric efficiency and reduces churning of the fluid and heating of the inlet region of the rotor.

DESCRIPTION OF THE PREFERRED EMBODIMENT$

Figure 1:
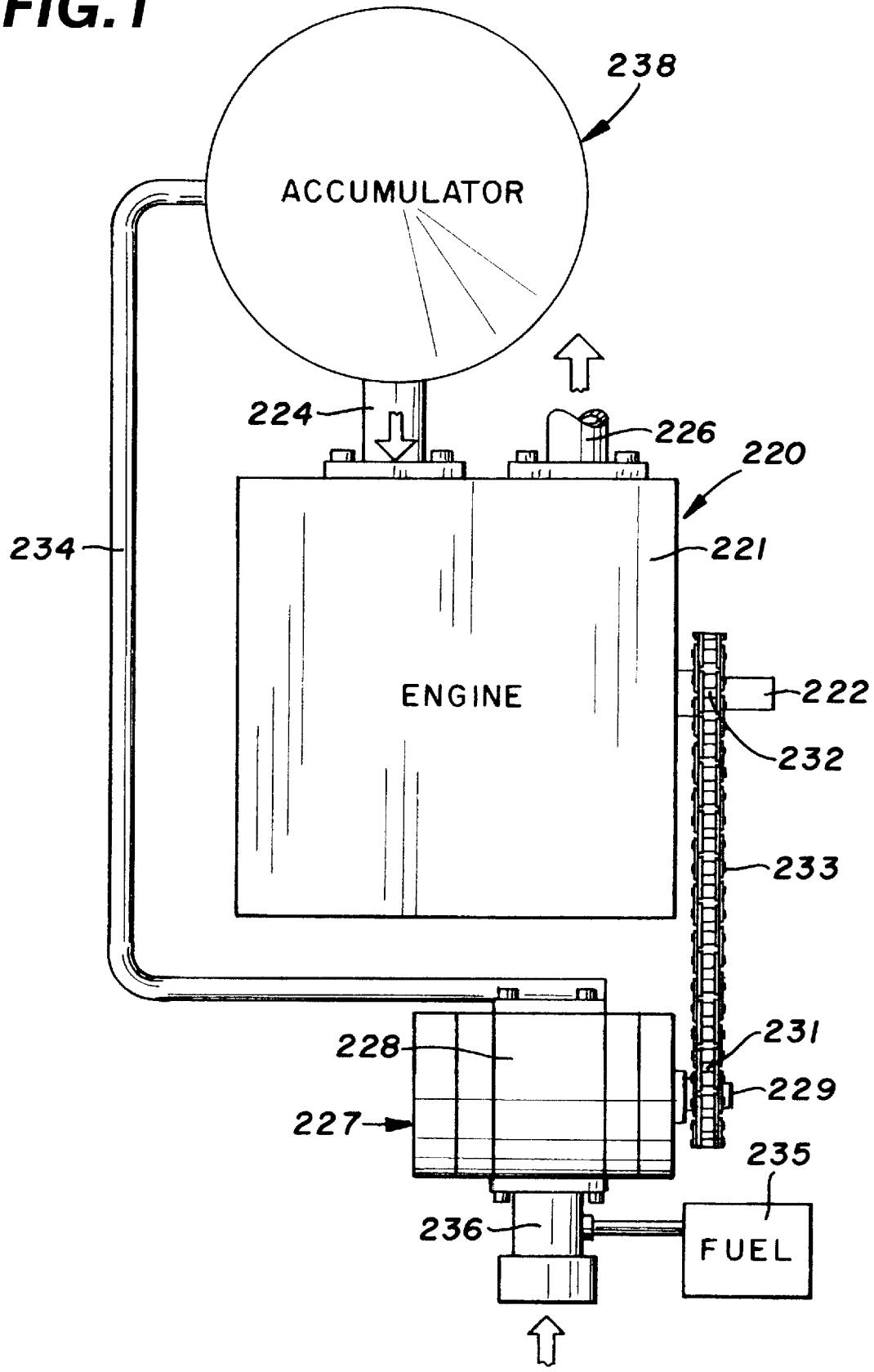
FIG. 1 is a diagrammatic view of an internal combustion engine operatively connected to the supercharger of the invention.
Figure 2:
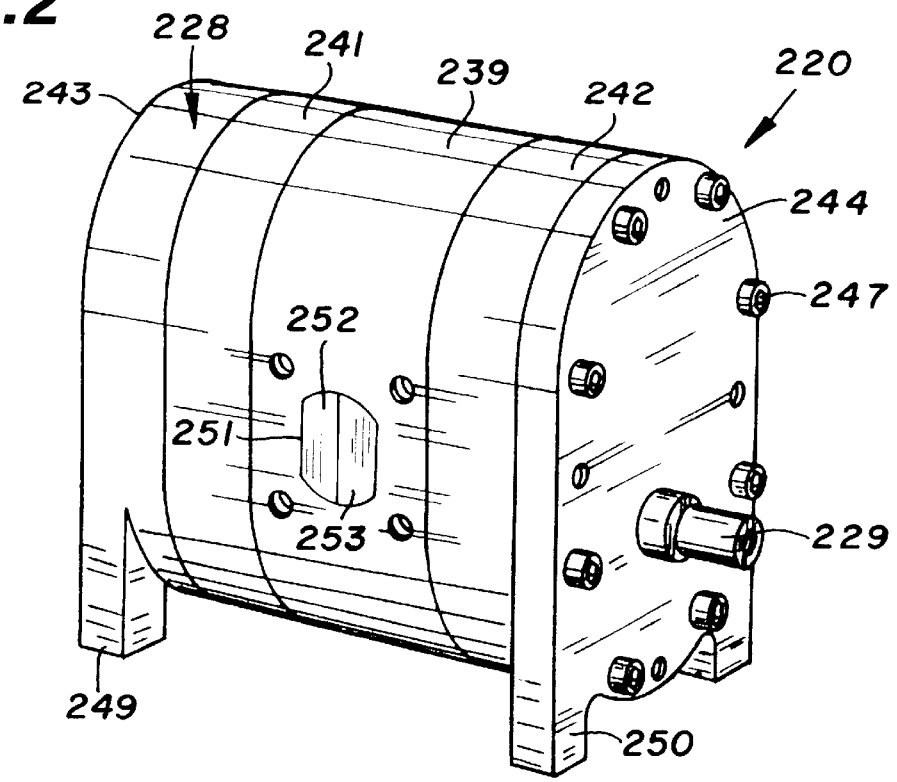
FIG. 2 is a perspective view of the supercharger of FIG. 1.
Figure 3:
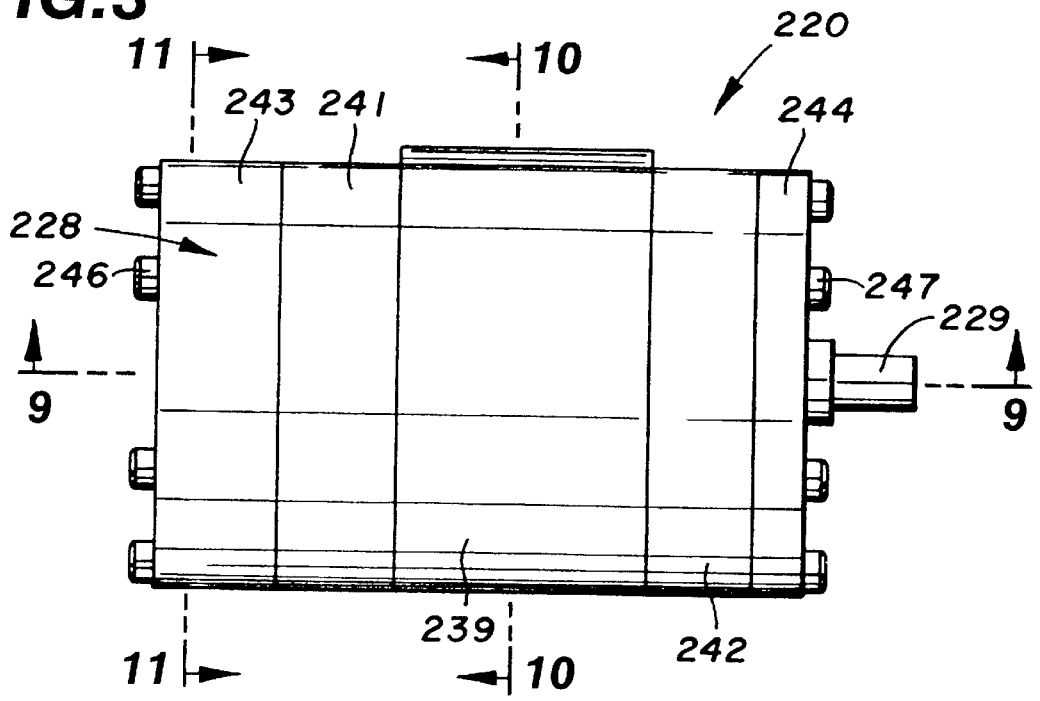
FIG. 3 is a top plan view of the supercharger of FIG. 2.

The supercharging system of the invention, shown in FIGS. 1 to 11, is used with an internal combustion engine 220 to increase the engine's volumetric efficiency and output horsepower. As shown in FIG. 15, engine 220 has a crank case 221 rotatably supporting a power output shaft 222. A fuel intake pipe or manifold 224 directs an air/fuel mixture to engine 220. An exhaust pipe 226 carries exhaust gas away from engine 220. Engine 220 is a single cylinder four cycle conventional air cooled internal combustion engine. An example of engine 220 is a five horsepower, single cylinder, four cycle internal combustion engine. Other types of internal combustion engines including two cylinder models are adaptable to the supercharging pump of the invention.

Engine 220 is supplied with an air/fuel mixture with a supercharger or fluid pump 227. Supercharger 227 has a housing 228 rotatably supporting a drive shaft 229. A power transmission comprising a first sprocket 231 on shaft 229, a second sprocket 232 on shaft 222, and an endless roller link chain 233 coupling sprockets 231 and 232 provides a direct drive between engine 220 and supercharger 227. Sprockets 231 and 232 have the same diameters whereby the RPM of engine 220 is the substantially the same as the operating speed of supercharger 227. Sprockets 231 and 232 can have a sprocket ratio to provide desired air flow to a specific engine size. Supercharger 227 is a positive displacement fluid pump operable to deliver a supply of air/fuel mixture to engine 220 to increase its adiabatic efficiency and horsepower. The air/fuel mixture flows through a pipe or tubular member 234 connected to supercharger 227 and intake pipe 224 of engine 220.

An air/fuel mixing device 236, known as a carburetor, mounted on housing 228 operates to introduce fuel, such as gasoline and alcohol, into air flowing through device 236 to provide an air/fuel mixture for engine 220. A fuel line 237 connected to device 236 carries liquid fuel from a tank 235 to device 236.

An air/fuel mixture accumulator 238 is in fluid communication with pipe 234 to hold a supply of an air/fuel mixture between the engine intake strokes without excessive pressure rise. For example, for a single cylinder engine the volume of accumulator 238 is about twelve times the engine displacement. Accumulator 238 has a funnel or cone shape which allows a vehicle driven with engine 220 to accelerate and corner without pooling of fuel in accumulator 238. Accumulator 238 has the same structure as accumulator 38 shown in FIG. 9 in U.S. Pat. No. 6,138,646. The accumulator 238 is mounted on a check valve assembly, which directs the air/fuel mixture to the intake port of engine 220. Supercharger 227 may be employed in multi-cylinder engines of three cylinders or greater without the need for accumulator 238.

Figure 4:
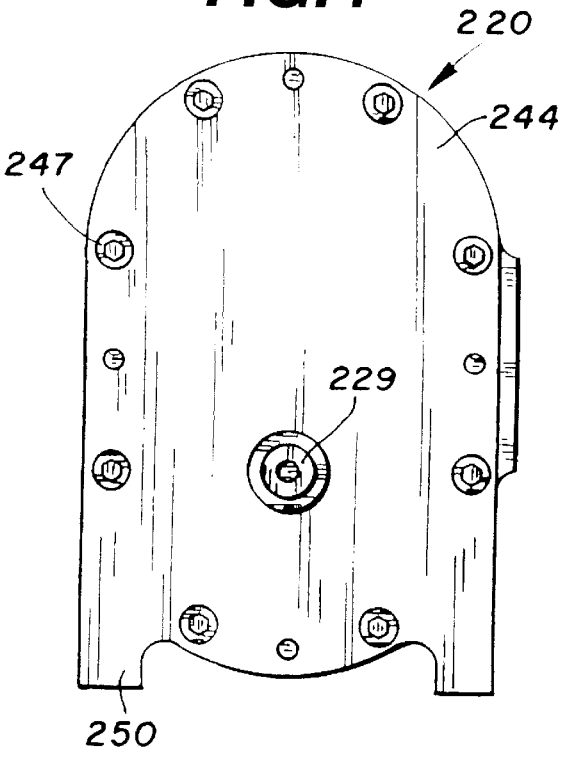
FIG. 4 is an end elevational view of the drive end of the supercharger of FIG. 2.
Figure 5:
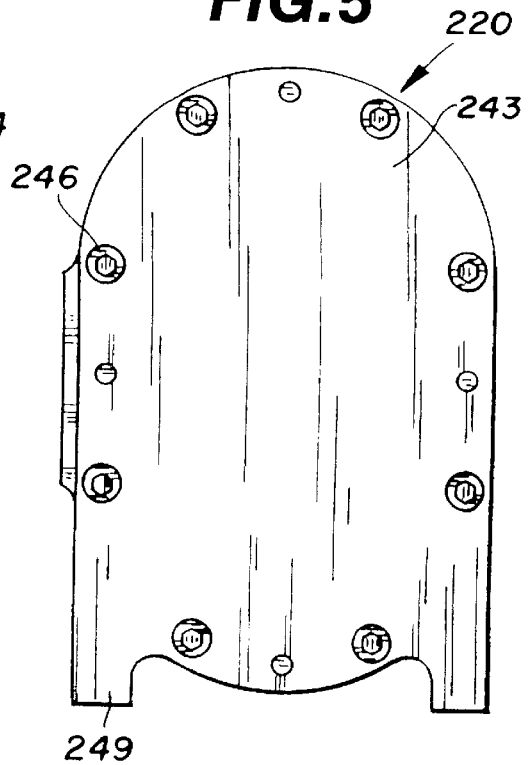
FIG. 5 is an end elevational view of the left end of the supercharger of FIG. 2.
Figure 6:
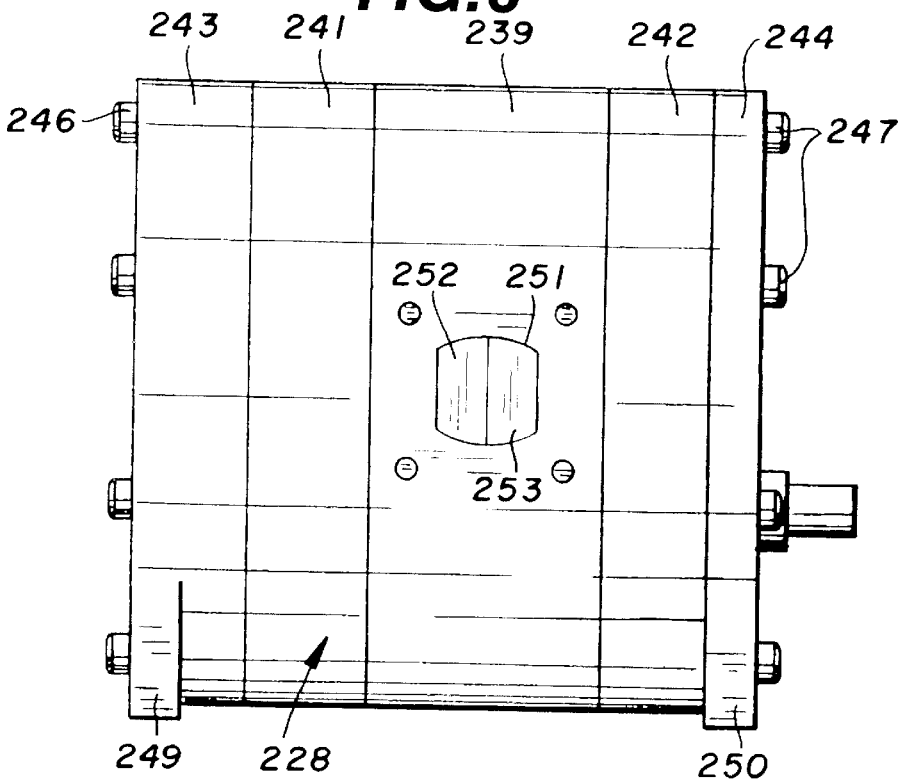
FIG. 6 is a front elevational view of the supercharger of FIG. 2.
Figure 7:
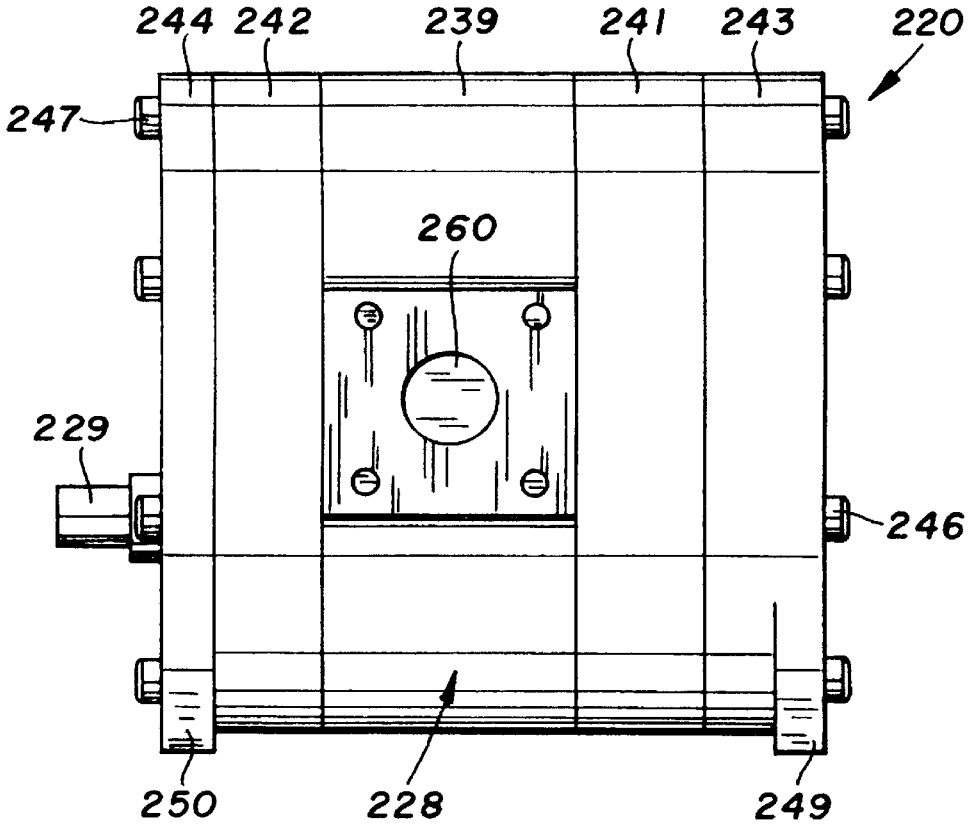
FIG. 7 is a rear elevational view of the supercharger of FIG. 2.
Figure 8:
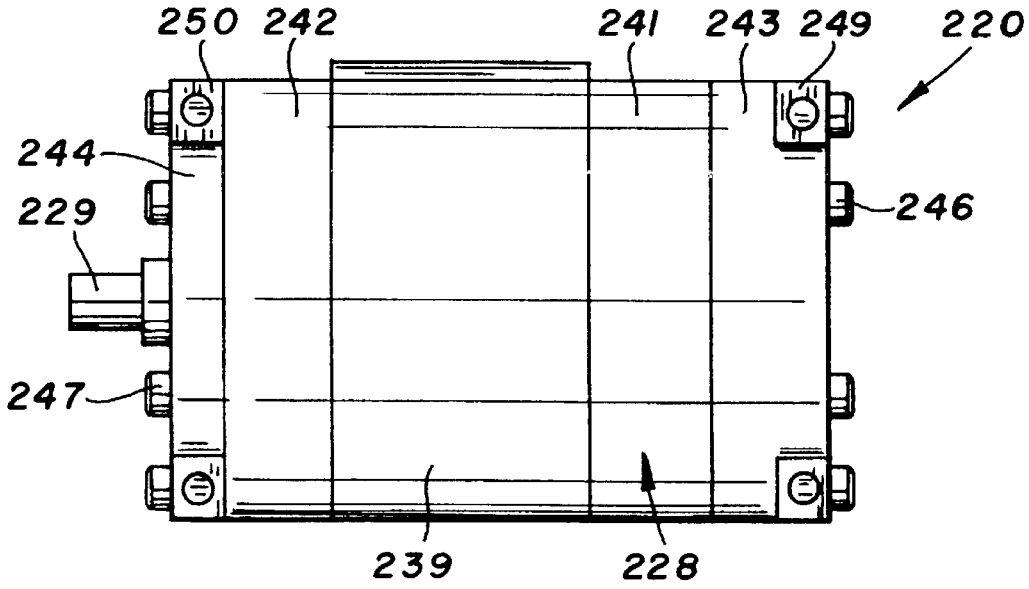
FIG. 8 is a bottom plan view of the supercharger of FIG. 2.

Supercharger housing 228, shown in FIGS. 2 to 8, has a central body 239 located between end members 241 and 242. A first cover plate 243 is located adjacent to the outside of end member 241. A plurality of bolts 246 attach end member 241 and cover plate 243 to body 239. A second cover plate 244 closes the outside of end member 242. A plurality of bolts 247 secure end member 242 and cover plate 244 to body 239. As shown in FIGS. 4,5 and 8, end member 243 has a pair of downwardly directed legs 249. End members 244 has a pair of downwardly directed legs 250 laterally aligned with legs 249. Each leg 249, 250 has a threaded bottom hole for accommodating a bolt to secure housing 228 to a fixed support. Body 239 has a side passage 251 open to a pair of passages 252 and 253 to carry the air/fuel mixture from device 236 to the interior chamber of body 239.

Body 239 has a first arcuate inside wall 254 surrounding a first chamber 256 and a second arcuate inside wall 257 surrounding chamber 258. Passage 252 is open to chamber 256 to allow the air/fuel mixture to flow in a tangential direction into chamber 256. Passage 253 is open to chamber 258 so that the air/fuel mixture flows in a tangential direction into chamber 258. Walls 254 and 257 have cylindrical surfaces which are machined with conventional machine tools. Body 239 has a central portion 259 separating passages 252 and 253. Opposite portion 259 is an air/fuel discharge port 260 for carrying the air/fuel mixture from chambers 256 and 258 to pipe 234 leading to engine intake and accumulator 238.

Figure 10:
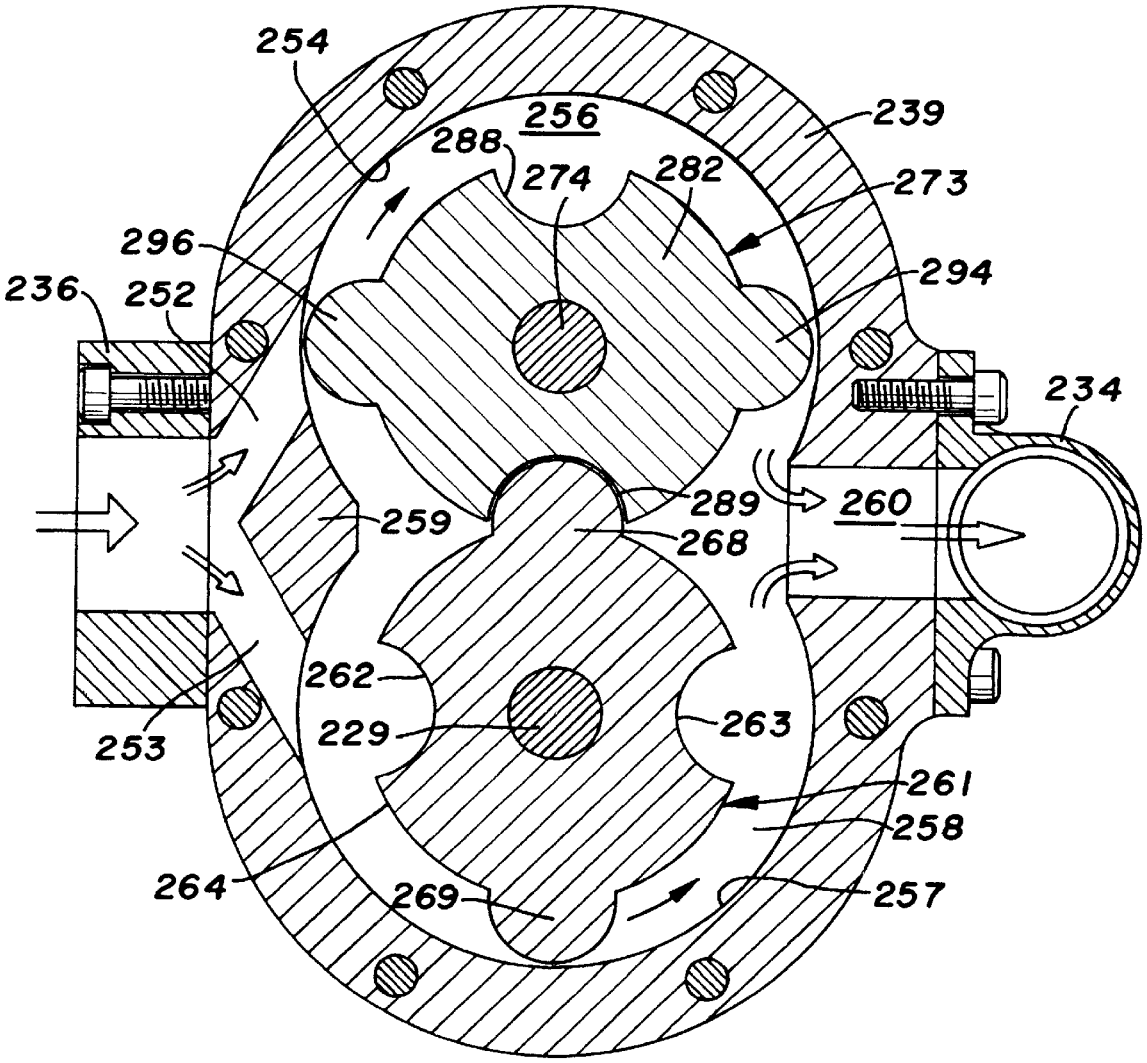
FIG. 10 is an enlarged sectional view taken along the line 10—10 of FIG. 3.

As shown in FIG. 10, a first rotor or rotating piston 261 mounted on shaft 229 is located in chamber 258. Rotor 261 has a pair of semi cylindrical pockets or recesses 262 and 263 open to opposite sections of its cylindrical outer surface 264. Body outer surface 257 is concentric with arcuate rotor surface 264. Surface 264 concentric with shaft 229 comprise segments of a cylinder pitch circle. Pockets 262 and 263 have semi-circular cross sections and semi-cylindrical surfaces. Pockets 262 and 263 are located in opposite sides of rotor 261. Rotor 261 has a pair of protrusions 268 and 269. As shown in FIG. 10, rotor surface 264 has four arcuate surface segments extended between adjacent pockets 262, 263 and protrusions 268, 269. Each arcuate surface segment has a radius extended from the axis of the shaft 229. The surface segments have the same arcuate lengths. The arcuate length of each arcuate surface is 50 degrees. The concave surfaces of rotor 261 forming each pocket 262 and 263 has a cross sectional concave arcuate length of less than 180 degrees. The concave arcuate length of each concave surface is about 170 degrees. Each protrusions 268 and 269 has a semi-cylindrical shape with an outer convex surface having a cross sectional circumferential length of 180 degrees. The radius of curvature of the outer convex surface of each protrusion is less than the radius of curvature of each concave surface of the pockets 262 and 263. The number and locations of pockets and protrusions can vary to maintain dynamic balance of rotor 261. Each protrusion 268, 269 has a generally semi-cylindrical shape located 90 degrees or normal to pockets 262 and 263. Protrusions 268 and 269 project outwardly in opposite directions from surface 264 to dynamically balance rotor 261. The outer apex portions of protrusions 268 and 269 are located in close non-contacting relationship with body surface 257. There is a small space between protrusions 268 and 269 and surface 257 to prevent wear and friction between adjacent surfaces of the protrusions and body 239 and generation of heat and noise.

Figure 9:
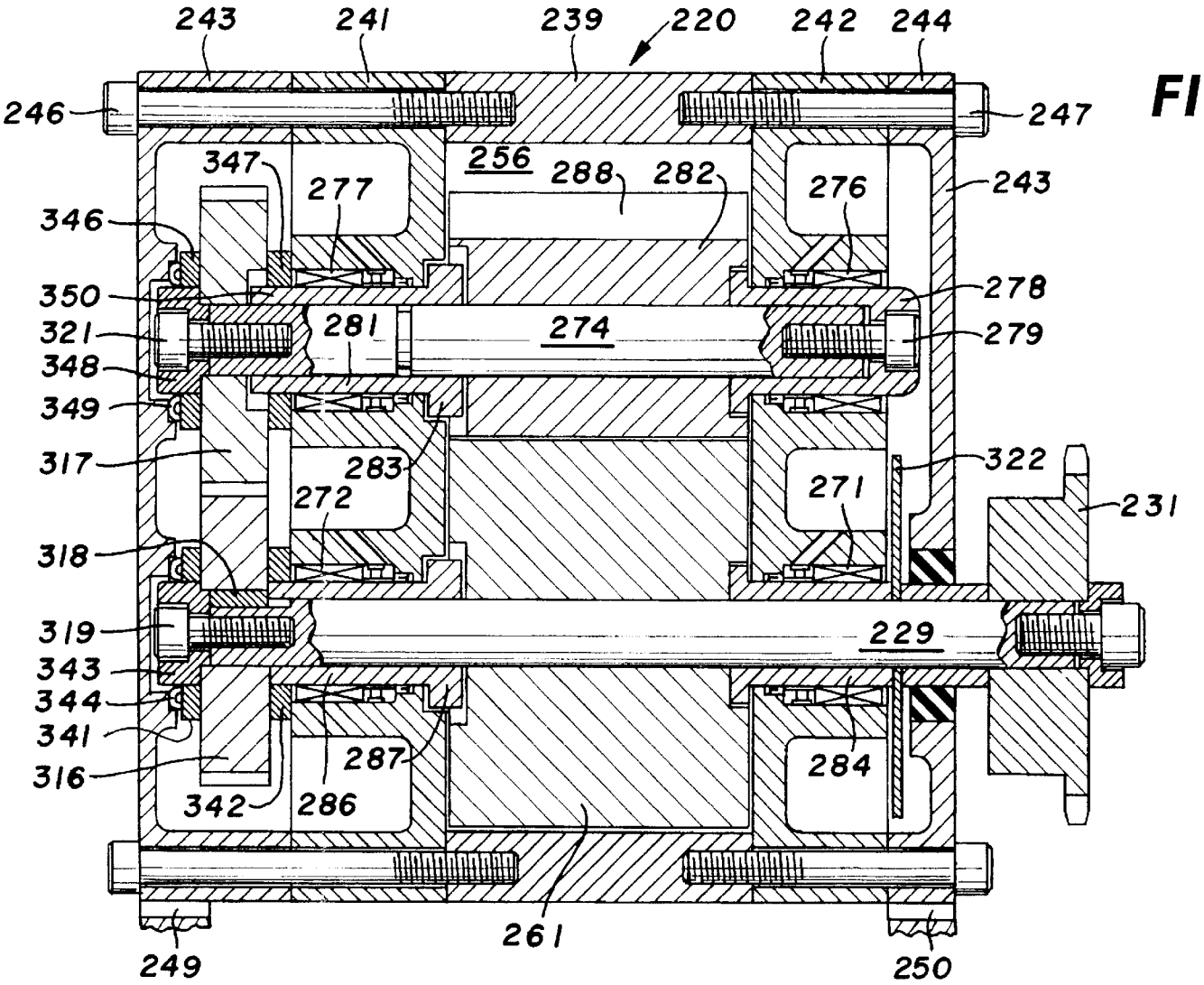
FIG. 9 is an enlarged sectional view taken along the line 9—9 of FIG. 3.

A second rotor or rotary piston 273 is mounted on a shaft 274. Rotor 273 has the same shape and structure as rotor 261. Opposite ends of shaft 274 are rotatably mounted on end members 241 and 242 with bearings 276 and 277, as seen in FIG. 9. A sleeve 278 secured to shaft 274 with a bolt 279 supports shaft 274 on bearing 276. A second sleeve 281 surrounding the opposite end of shaft 274 is keyed to rotor body 282 with a tongue and groove coupling 283. Sleeve 281 extends through bearing 277 whereby bearing 277 supports shaft 274 on end member 241.

Shaft 229 extends through sleeves 284 and 286 located adjacent opposite ends of body 261. Sleeve 284 extends through bearing 271 to support shaft 229 on end member 242. Sleeve 286 extends through bearing 272 to support shaft 229 on end member 241. A tongue and groove connection 287 drivably joins sleeve 286 to body 261 so that body 261 rotates with shaft 229.

Returning to FIG. 24, rotor body 282 has a pair of semi-cylindrical pockets 288 and 289 open to the outer cylindrical surface 291. Surface 291 is concentric with body surface 259. Surface 291 concentric with shaft 229 comprise segments of a cylinder pitch circle. The adjacent portions of surfaces 264 and 291 move in contiguous relationship as there is a small clearance between the adjacent surfaces. An example of this clearance is 0.005 to 0.007 inch. The rotor-to-rotor clearance reduces noise, wear of the rotors, and reduces heat generation. Pockets 288 and 289 are on opposite portions of body 282 and ninety degrees from a pair of protrusions 294 and 296. Each protrusion 294, 296 has a semi-cylindrical outer surface having the shape and configuration of pockets 262 and 263 of rotor 261. The outer apex portions of protrusions 294 and 296 are in close non-contacting relation with body surfaces 254. Protrusions 294 and 296 are integral portions of the monolithic rotor body 282. The rotors 261 and 273 and their protrusions 268, 269, 294 and 296 are one-piece structures. Rotors 261 and 273 are identical in size and shape. They can be made by an extrusion process and externally broached or shaved to finished size. Profile milling procedures can also be used to make the one-piece rotors 261 and 273. Large rotors can be hollow to reduce weight.

Figure 11:
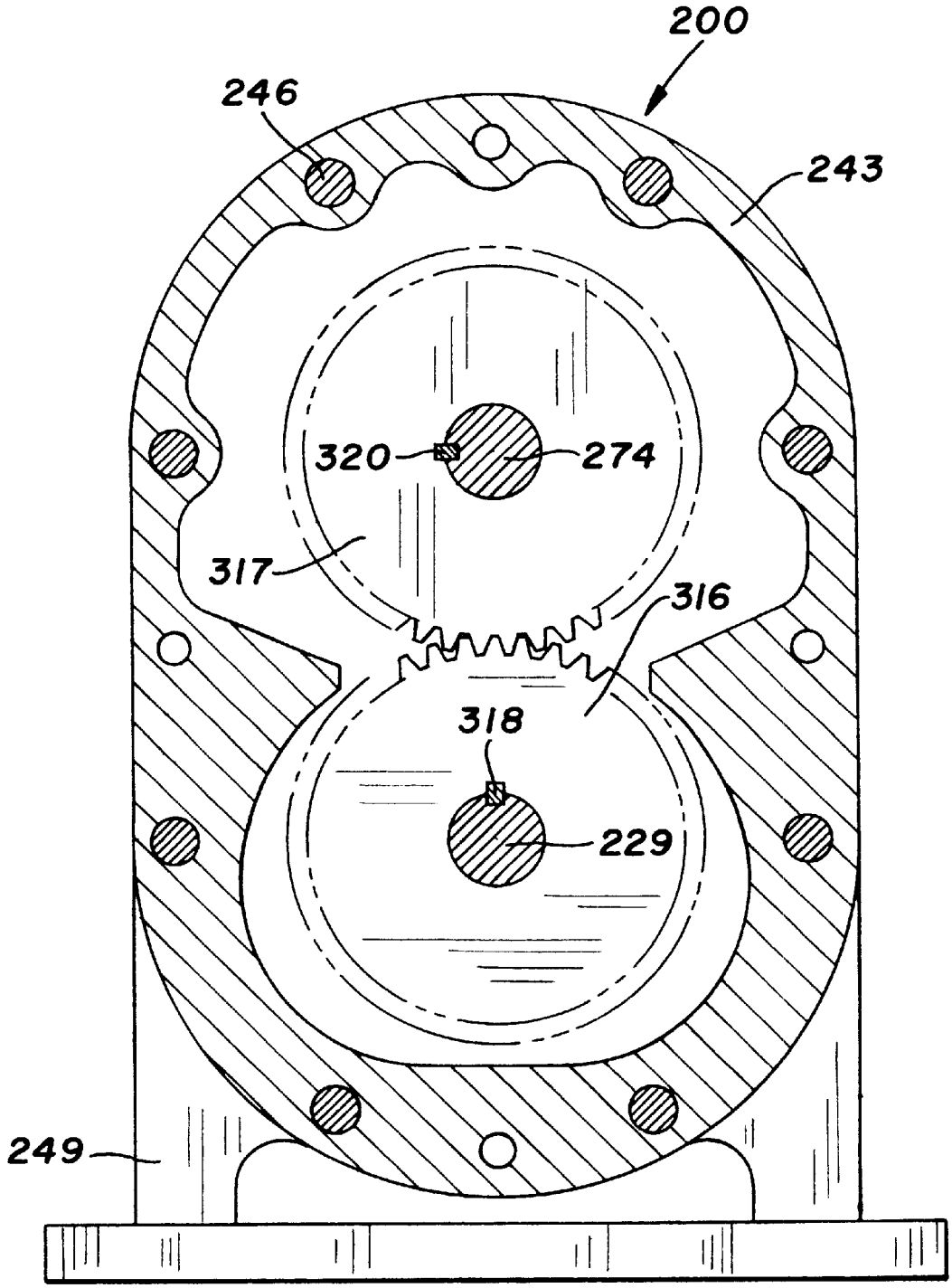
FIG. 11 is an enlarged sectional view taken along the line 11—11 of FIG. 3.

As shown in FIGS. 9 and 11, shafts 229 and 274 are drivably connected with spur gears 316 and 317 located within end cover 243. Gear 316 is fixed to shaft 229 with a key 318 and bolt 319. Gear 316 is located between thrust bearing washers 341 and 342. Washer 341 fits around an annular head 343 accommodating the head of bolt 219. Washer 342 surrounds sleeve 286. Washers 341 and 342 engage opposite sides of gear 316. An annular spring 344, such as a wave-type spring, located in a shallow recess in cover plate 243 engages washer 341 and biases the thrust bearing washers axially to retain washer 342 against end member 242. This locates the axial positions of the gear 316 and rotor 261. As shown in FIG. 9, the flat ends of rotor 261 are spaced a small distance from adjacent inside surfaces of end members 241 and 242. The small clearance between rotor 261 and end members 241 and 242 reduces wear, friction and heat generation during rotation of rotor 261. A bolt 321 secures gear 317 to shaft 274. A key 320 interconnects gear 317 with shaft 274 whereby gear 317 rotates shaft 274 and rotor 273. Bolt 321 retains gear 317 between thrust bearing washers 346 and 347. Washer 346 fits on a head 348 accomodating bolt 321. Washer 347 surrounds sleeve 281. A spring 349, such as an annular wave-like spring, located in a recess in cover plate 243 biases washer 346 to retain washer 347 against end member 242 to maintain the axial location of shaft 274, gear 317 and rotor 273. Rotor 273 has flat ends spaced a small distance from adjacent surfaces of end plates 241 and 242. The small clearance, seen in FIG. 23, between rotor body 282 and inside surfaces of end plates 241 and 242 reduces wear, friction and heat generation during rotation of rotor 273. Gears 316 and 317 have the same pitch diameters whereby shafts 229 and 274 rotate at the same speed. The pitch diameters of gears 316 and 317 are the same as the diameters of rotors 261 and 273. Rotors 261 and 273 turn in opposite directions at the same speed so that protrusions 268 and 269 register with pockets 288 and 289 in non-contact relation and protrusions 294 and 296 register with pockets 262 and 263 in non-contact relation during concurrent rotation of rotors 261 and 273. This reduces wear of the protrusions and rotor pockets and minimizes noise.

As shown in FIG. 9, cover plate 243 closes the open side of end member 242 and bearings 271 and 276. A flat disk 322 located between cover plate 243 and end member 241 is mounted on shaft 229. Disk 322 on rotation of shaft 229 moves a lubricant, such as oil, upward to lubricate bearings 271 and 276.

The present disclosure is preferred embodiments of the supercharger for an internal combustion engine. It is understood that the supercharger is not to be limited to the specific constructions and arrangements shown and described. It is understood that changes in parts, materials, arrangement and locations of structures may be made without departing from the invention.

What is claimed is:

1. A fluid mover comprising: a housing having a first chamber and a second chamber open to the first chamber, each chamber having an inside surface, said housing having a fluid intake passage and a fluid exhaust passage open to the chambers, first and second rotors located in the chambers to draw fluid through the intake passage, into the chambers, and force fluid out of the chambers through the fluid exhaust passage, first and second shafts having longitudinal axes, means rotatably mounting the first and second shafts laterally spaced and parallel to each other on the housing for rotation about the longitudinal axes of the shafts, means to concurrently rotate the first and second shafts in opposite directions, each rotor having a plurality of pockets and protrusions, said rotors having semi-cylindrical concave surfaces providing said pockets, each of said concave surfaces having a longitudinal axis, the distance between the longitudinal axes of the first and second shafts and the longitudinal axis of each concave surface is approximately one half the distance between the longitudinal axes of the first and second shafts, each of said protrusions having a semi-cylindrical outer surface with a radius smaller than the radius of the pocket, a longitudinal axis, the distance between the longitudinal axes of the first and second shafts and the longitudinal axis of each protrusion is approximately one half the distance between the longitudinal axes of the first and second shafts, said outer surfaces of the protrusions having a non-contact relation with the inside surfaces of the chambers and a non-contact relation with the pockets of the adjacent rotor when the rotors are rotated in opposite directions, the protrusions cooperating with the concave surfaces providing the pockets of the adjacent rotor to move fluid through the chambers when the rotors are rotated in opposite directions, said first rotor mounted on the first shaft and the second rotor mounted on the second shaft, each rotor having outer arcuate surface segments, the arcuate surface segments of the rotors having the same arcuate lengths and diameters, said means to concurrently rotate the shafts and rotors in opposite directions comprise a first spur gear mounted on the first shaft and a second spur gear mounted on the second shaft, said spur gears having engaging teeth whereby the first and second spur gears concurrently rotate said shafts and rotors, said first and second spur gears having pitch diameters that are the same as the diameters of the arcuate surface segments of the rotors, said housing having first and second side walls on opposite sides of the chamber, first and second thrust bearings located adjacent opposite sides of the gears secured to the shafts, said first thrust bearing engagable with the first side wall, and axial biasing means engagable with the second thrust bearing and the housing operable to bias the first thrust bearing into engagement with the first side wall to maintain the rotors in axial spaced relation relative to the first and second side walls of the housing.

2. The fluid mover of claim 1 wherein: each rotor has a body, and said protrusions are integral portions of the body.

3. The fluid mover of claim 1 wherein: the fluid intake passage includes a fluid inlet having two passages open to the chambers to allow fluid to flow in general tangential directions into the chambers.

4. A fluid mover comprising: a housing having a first chamber and a second chamber open to the first chamber, each chamber having an inside surface, said housing having a fluid intake passage and a fluid exhaust passage open to the chambers, first and second rotors located in the chambers to draw fluid through the intake passage, into the chambers, and force fluid out of the chambers through the fluid exhaust passage, first and second shafts having longitudinal axes, means rotatably mounting the first and second shafts laterally spaced and parallel to each other on the housing for rotation about the longitudinal axes of the shafts, means to concurrently rotate the first and second shafts in opposite directions, each rotor having a plurality of pockets and protrusions, said rotors having semi-cylindrical concave surfaces providing said pockets, each of said concave surfaces having a longitudinal axis located parallel to the axes of the shafts and approximately at the midpoint between the axes of the shafts, each of said protrusions having a semi-cylindrical outer surface with a radius smaller than the radius of the pocket, a longitudinal axis located parallel to the axes of the shafts and approximately at the midpoint between the axes of the shafts, said outer surfaces of the protrusions having a non-contact relation with the inside surfaces of the chambers and a non-contact relation with the pockets of the adjacent rotor when the rotors are rotated in opposite directions, the protrusions cooperating with the concave surfaces providing the pockets of the adjacent rotor to move fluid through the chambers when the rotors are rotated in opposite directions, said first rotor mounted on the first shaft and the second rotor mounted on the second shaft, each rotor having outer arcuate surface segments, the arcuate surface segments of the rotors having the same arcuate lengths and diameters, said means to concurrently rotate the shafts and rotors in opposite directions comprise a first spur gear mounted on the first shaft and a second spur gear mounted on the second shaft, said spur gears having engaging teeth whereby the first and second spur gears concurrently rotate said shafts and rotors, said first and second spur gears having pitch diameters that are the same as the diameters of the arcuate surface segments of the rotors, said housing having first and second side walls on opposite sides of the chamber, each rotor has opposite end walls, first and second thrust bearings located adjacent opposite sides of the gears secured to each shaft, said first thrust bearings being engagable with the first side wall, and axial biasing means engagable with the second thrust bearings and the housing to bias the first thrust bearings into engagement with the first side wall to maintain the end walls of each rotor in axial spaced relation relative to the first and second side walls of the housing.

5. A fluid mover comprising: a housing having a first chamber and a second chamber open to the first chamber, each chamber having an inside surface, said housing having a fluid intake passage, a fluid exhaust passage open to the chambers, and first and second side walls adjacent opposite sides of the chambers, rotor means located in the chambers to draw fluid through the intake passage, into the chambers, and force fluid out of the chambers through the fluid exhaust passage, a pair of parallel shafts having longitudinal axes, means rotatably mounting the shafts on the housing, said rotor means having a pair of rotors mounted on the shafts rotatably supported on the housing, means to concurrently rotate the shafts and rotors in opposite directions, means operatively associated with the shafts to maintain the rotors in axial spaced relation relative to the first and second side walls of the housing, each rotor having a plurality of pockets and protrusions, said protrusions being integral portions of the rotors and having a non-contact relation with the inside surfaces of the chambers and non-contact relation with the pockets of the rotors when the rotors are rotated, the protrusions cooperating with the pockets of the adjacent rotor to move fluid through the chambers when the rotors are rotated, each pocket having a concave surface with a generally semi-circular cross section, said concave surface having a longitudinal axis, the distance between the longitudinal axes of the first and second shafts and the longitudinal axis of each concave surface is approximately one half the distance between the longitudinal axes of the first and second shafts, each protrusion having a generally semi-cylindrical shaped outer surface with a radius smaller than the radius of the concave surface of the pocket, said semi-cylindrical outer surface of each protrusion having a longitudinal axis, the distance between the longitudinal axes of the first and second shafts and the longitudinal axis of each protrusion is approximately one half the distance between the longitudinal axis of the first and second shafts, each rotor having outer arcuate surface segments, the arcuate surface segments of the rotors having the same arcuate lengths and radii, said means to concurrently rotate the shafts and rotors comprising a first gear mounted on one shaft and a second gear mounted on the other shaft, said gears having engaging teeth whereby the first and second gears concurrently rotate said shafts and rotors in opposite directions, said first and second gears having pitch diameters that are the same as the diameters of the arcuate surface segments of the rotors, said housing having first and second side walls on opposite sides of the chamber, first and second thrust bearings located adjacent opposite sides of the gears secured to the shafts, said first thrust bearing engagable with the first side wall, and axial biasing means engagable with the second thrust bearing and the housing operable to bias the first thrust bearing into engagement with the first side wall to maintain the rotors in axial spaced relation relative to the first and second side walls of the housing.

6. The fluid mover of claim 5 wherein: the fluid intake passage includes a fluid inlet having two passages open to the chambers to allow fluid to flow in tangential directions into the chambers.

7. The fluid mover of claim 5 wherein: each rotor has two pockets open to opposite first portions of the rotor and two protrusions extended outwardly from opposite second portions of the rotor, said second portions of the rotor being located 90 degrees from the first portions of the rotor.

8. A fluid mover comprising: a housing having a first chamber and a second chamber open to the first chamber, each chamber having an inside surface, said housing having a fluid intake passage, a fluid exhaust passage open to the chambers, and side walls adjacent opposite sides of the chambers, rotor means located in the chambers to draw fluid through the intake passage, into the chambers, and force fluid out of the chambers through the fluid exhaust passage, a pair of parallel shafts rotatably mounted on the housing, said rotor means having a pair of rotors mounted on the shafts rotatably supported on the housing, means to concurrently rotate the shafts and rotors, means operatively associated with the shafts to maintain the rotors in axial spaced relation relative to the side walls of the housing, each rotor having a plurality of pockets and protrusions, said protrusions being integral portions of the rotors and having a non-contact relation with the inside surfaces of the chambers and non-contact relation with the pockets of the rotors when the rotors are rotated, the protrusions cooperating with the pockets of the adjacent rotor to move fluid through the chambers when the rotors are rotated, each pocket having a concave surface with a generally semi-circular cross section, each protrusion having a generally semi-cylindrical shaped outer surface with a radius smaller than the radius of the concave surface of the pocket, each rotor having outer arcuate surface segments, the arcuate surface segments of the rotors having the same arcuate lengths and radii, said means to concurrently rotate the shafts and rotors comprising a first gear mounted on one shaft and a second gear mounted on the other shaft, said gears having engaging teeth whereby the first and second gears concurrently rotate said shafts and rotors in opposite directions, said first and second gears having pitch diameters that are the same as the diameters of the arcuate surface segments of the rotors, each rotor has opposite end walls, said means to maintain the rotors in axial spaced relation relative to the side walls of the housing comprising first and second thrust bearings located adjacent opposite sides of the gears secured to each shaft, said first thrust bearings being engagable with the first side wall, and axial biasing means engagable with the second thrust bearings and the housing to bias the first thrust bearings into engagement with the first side wall to maintain the end walls of the rotors in spaced relation to the first and second side walls of the housing.

9. A fluid mover comprising: a housing having a first chamber and a second chamber open to the first chamber, each chamber having an inside surface, said housing having a fluid intake passage, a fluid exhaust passage open to the chambers, and first and second side walls adjacent opposite sides of the chambers, rotor means located in the chambers operable to draw fluid through the intake passage, into the chambers, and force fluid out of the chambers through the fluid exhaust passage, a pair of parallel shafts, roller bearings rotatably mounting the shafts on the housing, said rotor means having a pair of rotors mounted on the shafts, each rotor having opposite end walls, gear means to concurrently rotate the shafts and rotors, first and second thrust bearings located adjacent opposite sides of the gear means, said first thrust bearings being engagable with the first side wall, and axial biasing means engagable with the second thrust bearings and the housing to bias the first thrust bearing into engagement with the first side wall to maintain the opposite end walls of the rotors in axial spaced relation relative to the first and second side walls of the housing, each rotor having a plurality of pockets and protrusions, said protrusions being integral portions of the rotors and having a non-contact relation with the inside surfaces of the chambers and non-contact relation with the pockets of the rotors when the rotors are rotated, the protrusions cooperating with the pockets of the adjacent rotor to move fluid through the chambers when the rotors are rotated, each pocket having a concave surface with a generally semi-circular cross section, each protrusion having a generally semi-cylindrical shaped outer surface with a radius smaller than the radius of the concave surface of the pocket, each rotor having outer arcuate surface segments, the arcuate surface segments of the rotors having the same arcuate lengths and radii.

10. The fluid mover of claim 9 wherein: the fluid intake passage includes a fluid inlet having two passages open to the chambers to allow fluid to flow in tangential directions into the chambers.

11. The fluid mover of claim 9 wherein: said gear means have pitch diameters that are the same as the diameters of the arcuate surface segments of the rotors.

12. The fluid mover of claim 9 wherein: each rotor has two pockets open to opposite first portions of the rotor and two protrusions extended outwardly from opposite second portions of the rotor, said second portions of the rotor being located 90 degrees from the first portions of the rotor.

* * * * *